US005477430A

United States Patent [19]

LaRose

[11] Patent Number: 5,477,430

[45] Date of Patent: Dec. 19, 1995

[54] FLUORESCING KEYPAD

[75] Inventor: Charles W. LaRose, Kokomo, Ind.

[73] Assignee: Delco Electronics Corporation, Kokomo, Ind.

[21] Appl. No.: 404,387

[22] Filed: Mar. 14, 1995

[51] Int. Cl.[6] ..... F21V 9/16

[52] U.S. Cl. ..... 362/84; 362/24; 362/30; 362/260; 200/314; 40/543

[58] Field of Search ..... 362/23, 24, 29, 362/30, 88, 84, 260, 806, 812; 40/542, 543; 200/314

[56] References Cited

U.S. PATENT DOCUMENTS

| | | | |
|---|---|---|---|
| 3,694,945 | 10/1972 | Detiker | 40/133 R |
| 4,729,067 | 3/1988 | Ohe | 362/26 |
| 5,407,721 | 4/1995 | Fujigaki et al. | 200/314 X |

*Primary Examiner*—Stephen F. Husar
*Attorney, Agent, or Firm*—Jimmy L. Funke

[57] ABSTRACT

A backlit component is provided which is suitable for use in an illuminated graphic display in an instrument panel of an automobile. The backlit component can be formed as a molded plastic button for use in a display group forming a keypad, in which minimal variability of backlighting intensity can be readily achieved within the backlit component as well as within the display group. The backlit component is preferably molded from a translucent substrate in which at least one phosphor additive is dispersed. The phosphor additive is preferably uniformly dispersed such that the backlit component is characterized by a substantially uniform backlighting intensity upon the phosphor additive being excited by an appropriate light source in proximity to the backlit component. The light source can be received within a recess formed in the backlit component, or spaced apart from the component, in which case light emitted by the light source may be transmitted by a recess or light pipe integrally formed in the component. An insignia can be formed on the surface of the component, and phosphors capable of fluorescing in different colors can be combined to produce essentially any backlighting color.

20 Claims, 1 Drawing Sheet

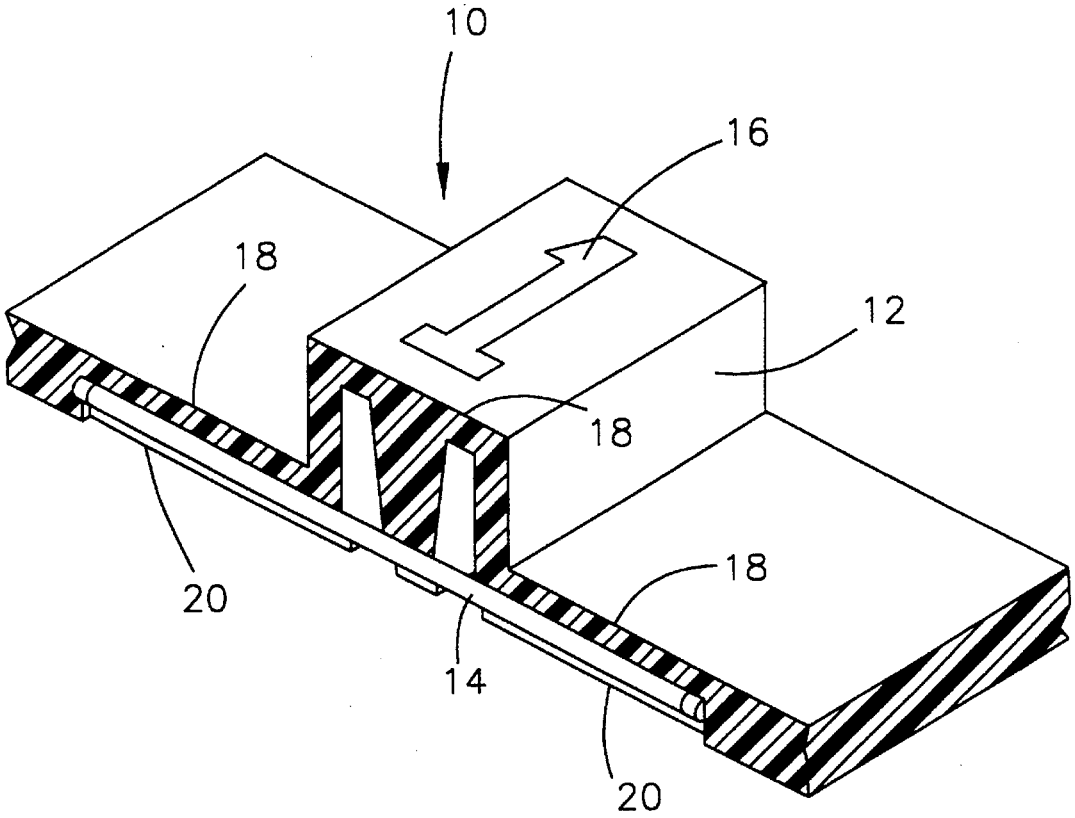
10
16
18
12
18
18
20
14
20

FLUORESCING KEYPAD

The present invention generally relates to illuminated graphic displays and buttons used on the instrument panel of an automobile. More particularly, this invention relates to a key pad formed from an optically clear material in which a phosphor color additive is dispersed, such that the key pad will fluoresce when excited by an appropriate light source.

BACKGROUND OF THE INVENTION

Illuminated graphic displays and buttons for automotive applications such as radios often have backlit insignia which identify the particular function of the display or button. Such backlit components have a light source which is positioned behind the insignia in order to make the insignia visible in the dark, necessitating that the insignia be capable of transmitting light from the light source.

A known process for manufacturing buttons and other backlit components is the use of paint and laser technology. These processes have generally involved the use of a transparent plastic substrate which may be painted white to form a white translucent layer over the transparent substrate, and then painted black to form an opaque black covering over the substrate and, if present, the white translucent layer. The black covering is then lased away to form an insignia. The transparent nature of the substrate maximizes the transmission of light through the backlit component for night time viewing. If present, the white translucent layer contributes graphics whiteness by reflecting light, such that the insignia is more readily visible under natural lighting conditions during daylight hours.

Numerous variations of the above structure exist. For example, U.S. Pat. No. 4,729,067 to Ohe teaches the use of a transparent substrate over which is sequentially deposited a translucent layer and a light diffusing layer. The translucent layer serves to bond the light diffusing layer to the transparent substrate, and enhance the diffusion of the light transmitted through the substrate into the light diffusing layer. However, the layers are delineated by chemically reacted surfaces, making the utilization of the teachings of Ohe rather complicated and expensive for mass production.

Another variation is disclosed in U.S. Pat. No. 3,694,945 to Detiker, which teaches the use of a white translucent substrate over which is formed an opaque grating composed of an opaque reflective layer and a translucent cover layer. The reflective layer serves to prevent light emitted from a light source beneath the substrate from reaching the covering layer, and then reflects the light back toward the substrate. Consequently, light emitted by the light source escapes only through openings in the grate. However, generating a grate in accordance with Detiker is relatively expensive and limits the use of such techniques to relatively large displays.

Paint and laser techniques of the type noted previously also have significant shortcomings. Insignias typically used in automobile graphic displays have a stroke width (the line width of the insignia) of only about 0.5 millimeter. Obtaining suitable optical characteristics with such intricate graphics requires very tight control of the cured thickness of the white paint in order to maintain the desired reflectance and transmissive properties. Often, as a result of the limitations of paint processes and paint chemistry, the thickness of the white paint must be maintained within a narrow range in order to achieve suitable lighting intensities for daytime and nighttime viewing. However, the variation in thickness between backlit components within a display group must be maintained within an even narrower range in order to provide a uniform lighting appearance.

Furthermore, the insignia of a backlit component formed in accordance with known methods will tend to have a nonuniform backlighting intensity unless the light transmitted to the component is appropriately and uniformly distributed over the entire area of the insignia. In practice, it is extremely difficult to achieve uniform distribution of light, which is typically accomplished with a light pipe whose geometry must be repetitively altered until a suitably uniform backlit intensity is achieved.

Even if uniform intensity is achieved within a single backlit component, differences in adjacent insignia often result in irregular illumination intensities within a backlit display group. This is particularly true with buttons of a backlit display which share one or more light sources. To minimize costs, such groupings often use a minimum number of light sources, and incorporate light pipes for the purpose of distributing the light energy equally to each of the backlit components. Though much effort has been directed toward optimizing the design of light pipes, uniform backlighting of each and every backlit component is very difficult due to size and location restraints. As a result, facets and painted patterns have often been applied to light pipes in order to increase the light intensity directed to relatively dim areas. Often, reflectors and additional lamps have been required, while excessively bright areas have been attenuated with printed halftone patterns behind the individual insignia.

While such tactics have been effective for flat screen printed displays, it is very costly and poorly suited for buttons and other backlit components which are not flat and have low lighting intensities. The above is further complicated where different shades or colors are desired for components within a backlit display group. As a result, lead times for developing a backlit display can be relatively long, adding undesirable development costs to the end product.

From the above, it can be seen that the prior art lacks a backlit component which can be readily produced to have a uniform and predictable backlit intensity. Accordingly, it would be desirable if a process existed by which a backlit component could be readily manufactured with minimal variability in backlighting intensity. Such a method would allow adjacent backlit components to be individually tailored to exhibit a suitable level of backlighting intensity when backlit by a minimal number of light sources.

SUMMARY OF THE INVENTION

It is an object of this invention to provide a molded backlit component characterized by minimal variability in backlighting intensity within the component.

It is a further object of this invention to provide a backlit component which can be molded from a translucent substrate which is formulated to include a fluorescent material, such that the backlit component will emit a suitable level of light intensity when backlit by a minimal number of light sources.

It is another object of this invention to provide a backlit component whose backlighting intensity is not heavily dependent on the proximity, intensity or geometry of a light source or light pipe.

It is yet another object of this invention to provide a backlit component whose backlit color can be readily tailored for a given application.

In accordance with a preferred embodiment of this invention, these and other objects and advantages are accomplished as follows.

According to the present invention, there is provided a backlit component which is suitable for use in an illuminated graphic display in an instrument panel of an automobile. In particular, the backlit component can be a non-flat molded plastic button for use in a display group forming a keypad, in which minimal variability of backlighting intensity can be readily achieved within the backlit component as well as within the display group. The backlit component is preferably molded from a translucent substrate such as an optically clear silicone in which at least one phosphor additive is dispersed. The phosphor additive is preferably uniformly dispersed in the optically clear silicone such that the backlit component is characterized by a substantially uniform backlighting intensity upon the phosphor additive being excited by a light source in proximity to the backlit component. The light source can be received within a recess formed in the backlit component, or spaced apart from the component, in which case light emitted by the light source is transmitted by a recess or light pipe integrally formed in the component. To customize the backlit component, a graphic or insignia can be formed on the surface of the component. For example, a coating can be formed over the component, and an insignia can be defined by an opening through the coating, such that a portion of the component is exposed through the opening.

In accordance with this invention, the color and backlighting intensity of the backlit component can be readily controlled by the type and amount of phosphor additive dispersed in the substrate. As such, the backlighting intensity of a backlit component is not heavily dependent on the proximity, intensity or geometry of a light source or light pipe. Instead, the material used to form the component can be readily tailored to produce the backlighting effect desired for a given application.

As a result, an additional advantage of the present invention is that the manufacture of a backlit component is relatively uncomplicated, requiring significantly shorter lead times than that possible using prior art methods. A suitable method can be a liquid injection molding operation in which a two-component liquid composition is delivered to a molding machine. Simultaneously, one or more additional liquid compositions laden with one or more different phosphor additives can be delivered to the machine for mixing with the first composition. As such, the color and shade of light emitted by the component can be readily tailored during the molding operation by altering the proportion of the compositions fed to the molding machine. After molding, the components can be inspected practically immediately so as to enable in-process modifications to be performed for achieving the desired backlighting effect.

In view of the above, it can be appreciated that the manufacturing method made possible by this invention avoids the shortcomings of the prior art. Particularly, the method of this invention does not involve precisely controlling the shape of the backlit component or the proximity, shape or intensity of the light source used to excite the phosphor additive. As such, the method is significantly more practical and cost effective. Under many circumstances, each of the backlit components within a display group can be molded with a single mold and subsequently finished as a set.

Other objects and advantages of this invention will be better appreciated from the following detailed description.

BRIEF DESCRIPTION OF THE DRAWINGS

The above and other advantages of this invention will become more apparent from the following description taken in conjunction with the accompanying drawings, in which a backlit component capable of being produced in accordance with this invention is shown in cross-section.

DETAILED DESCRIPTION OF THE INVENTION

The present invention is directed toward illuminated graphic displays composed of molded plastic backlit components, such as the non-flat backlit component 10 shown in the FIGURE, which serve as interior controls for an instrument panel of an automobile. The invention entails a backlit component 10 which can be more readily manufactured to have minimal variability in backlighting intensity within itself as well as in comparison to adjacent backlit components.

For illustrative purposes, the backlit component 10 is shown in the FIGURE as including a single button 12 and a single light source 14 disposed within a recess 20 formed integrally within the base of the backlit component 10. Alternatively, the light source 14 could be spaced from the backlit component 10, with a light pipe (not shown) serving to transmit the light from the light source 14 to the button 12. Those skilled in the art will recognize that the configuration shown in the FIGURE is merely one example of numerous possible arrangements, in which one or more backlit components are illuminated by one or more light sources, optionally in cooperation with one or more light pipes of any one of numerous designs and configurations. The specific characteristics of the light source 14 and any light pipe employed are not generally features of this invention, and the numerous possible variations in their design are generally within the knowledge and skill of those skilled in the art.

The button 12 is shown as having a structure which is compatible with the teachings of this invention. The button 12 is generally formed as a substrate over which a suitable opaque cover layer 18 is formed. Portions of the underlying substrate are exposed by openings in the cover layer 18 so as to define an insignia 16 on the surface of the button 12. With this arrangement, light transmitted through the substrate will render the insignia 16 clearly visible to an observer for night or daytime viewing. However, as a key aspect of this invention, the substrate of the button 12 is not limited to transmitted light from the light source 14 to the surroundings. Instead, the substrate includes a dispersion of one or more fluorescing materials, or phosphors, such that the button 12 will luminesce when exposed to visible light. In other words, the button 12 will appear to produce visible light through the process of the phosphor material being excited by light emitted by the light source 14. More accurately, the phosphor material dispersed in the substrate will emit visible radiation (unaccompanied by high temperature) as a result of absorption of excitation energy from the light source 14 in the form of photons.

In a preferred embodiment, the light source 14 is an ultraviolet (UV) light source, which is capable of exciting the phosphor material while requiring minimal power and generating minimal heat. However, it is foreseeable that LED or fluorescent light sources could be used depending on the amount of ultraviolet light produced by the light source and the amount of ultraviolet light required to appropriately excite the phosphor material.

A preferred construction for the backlit component 10 is as follows. The substrate of the component 10 is preferably formed from a translucent polymeric material, such as an optically clear silicone, in which suitable phosphor materials are dispersed, though other suitable polymeric materials could foreseeably be used. For purposes of this invention, the substrate must be sufficiently translucent in order to have a suitable light transmission capability so as to enable light energy from the light source 14 to reach and excite the phosphor material dispersed in the substrate. A particularly suitable material has been found to be a two-component liquid silicone composition available from General Electric Plastics as the LIM 6000 series of materials, where "LIM" designates a Liquid injection molding material. The preferred composition produces a component 10 having a hardness of about Shore A 45, though the hardness can be tailored to satisfy the particular requirements of an application. Another suitable material appears to be an experimental LIM silicone designated by General Electric Plastics as GE 29605.

Preferred phosphor materials include ULTRAVIOLET PHOSPHOR TYPE A, manufactured by Nemoto, Ltd., of Japan, and available in the U.S. from the United Mineral Company of Lyndhurst, N.J. Various color designations for this material are available, including SPE-A, ALN-B, ALN-G, HG-A YO, YS-A, HR-H, 3955BR, 420B and LAL-A. Notably, any two or more of these phosphor materials can be mixed to match essentially any color desired for a particular application. As a result, the button 12 can be readily formulated to fluoresce in a color suitable for any given application. Neutral density filters can also be dispersed in the substrate if desired in order to modulate the intensity of the light emitted by a button 12. A neutral density filter is required only with the use of a UV light source for the purpose of filtering out visible light in roughly the 400 to 750 nanometer range. A suitable neutral density filter is Part Number 38-0010-01 available from U/V Products, though various other filters and filter sizes may be used to correspond with the size of the UV light source.

The cover layer 18 can be any suitable coating material which exhibits the required capability of providing correct opacity, gloss and color within a thickness range suitable for production. Preferred coating materials for the cover layer 18 are specially compounded inks/paints produced by blending one or more of the preferred phosphor materials into a carrier that will adhere to the polymeric substrate material of the component 10. Such carriers and blending techniques are generally known in the art, and therefore will not be discussed in further detail. One or more layers of such coating materials can be used to form the cover layer 18, as may be desired for a particular application. These coating materials can be readily lased to form the insignia 16. The appearance of the insignia 16 can be modified by forming an underlying layer (not shown) beneath the cover layer 18, and then lasing the cover layer 18 to the extent necessary to expose the underlying layer and form the insignia 16. If desired, the underlying layer can be impregnated with one or more phosphor materials, in addition to or instead of impregnating the substrate material of the component 10.

As will become apparent from the following description, the use of fluorescence to provide backlighting for an illuminated graphic display greatly simplifies the development of a particular display panel for the interior controls of an automobile. In particular, where it was formally necessary to repeatedly test light pipes with different shapes at various positions within a display panel in order to arrive at a light pipe which effectively and directly serves to produce the backlighting effect, the present invention eliminates the requirement for a light pipe. Instead, it is only necessary to transmit a suitable excitation energy, preferably in the form of UV light, to the phosphor material dispersed in the substrate of the component 10, in order to achieve the desired backlighting effect. As such, the composition of the substrate is formulated to produce the backlighting effect, and the geometry of the button 12 and the placement and shape of the light source 14 have minimal effect. As a result, a wide range of backlighting intensities of practically any color can be achieved with minimal lead time required for development.

A preferred method by which backlit components 10 are formed in accordance with this invention involves conventional processing equipment. The preferred embodiment employs a liquid injection molding operation to produce silicone rubber components 10. This process generally includes delivering a two-component liquid silicone composition, such as that noted previously, to a liquid injection molding station, where the mixture is fed into a molding machine screw for further mixing. Simultaneously, a second liquid silicone composition formulated to include phosphor material is also transported to the molding machine screw. The second mixture can be lightly or heavily laden with phosphor materials of any color, as may be required for a particular application. The ratio at which the first and second mixtures are fed to the molding machine screw will determine the degree of fluorescence for the button 12 molded from the composition.

The molding machine screw then transports and injects the resulting mixture into a suitable mold for producing the component 10. Following the molding operation, the cover layer 18 can be applied, if desired, in a conventional manner. Using known laser techniques, the insignia 16 can then be lased into the surface of the button 12 through the removal of portions of the cover layer 18. Suitable laser techniques are well known in the art and will not be discussed further. In addition, other techniques for forming the insignia 16 could also be adopted by those skilled in the art.

Assembly of the component 10 with its display panel can then be performed. The light source 14 can be inserted into the recess 20 formed in the lower surface of the component 10, or supported some distance away from the component 10, wherein the recess 20 may be formed to serve as a light pipe to promote the transmission of light from the light source 14 to the button 12. However it is important to note that, in serving as a light pipe, the recess 20 would not require intensive design as would a conventional light pipe used in backlit displays, in that the recess 20 does not significantly determine the lighting effect of the button 12, but merely serves as a conduit for transmitting a sufficient amount of UV energy from the light source 14 to the button 12.

From the above, it can be seen that an advantage of the present invention is that the shape of the button 12 and the light source 14 are not primarily determinant of the backlighting effect achieved by this invention. Instead, the backlighting effect is produced by the ability of the dispersed phosphor materials to inherently distribute light uniformly throughout the silicone substrate of the component 10. As a result, the present invention is a substantial improvement over prior art backlit display technology, in which considerable trial and error is involved in attempts to achieve a suitable balance between light delivery to a backlit component and distribution of light within the component. By reducing the amount of development time and effort, backlit displays can be produced with significantly shorter lead times and at significantly lower costs.

Furthermore, because the geometry of the button 12 is not generally critical, it is possible for identical molds to be used to produce keys used in numerous different applications. Production tooling for the buttons 12 can therefore be simplified, further reducing the manufacturing costs for a backlit display.

Generally then, a significant advantage of this invention is that keypads for a display panel can be more readily mass produced to exhibit substantially equal backlighting intensities, due to the backlighting effect being dependent on the material composition of the buttons within the display, as opposed to the placement and arrangement of light sources behind the display. Furthermore, backlit components manufactured in accordance with the method of this invention can be readily produced to exhibit an acceptable graphics brightness level under both daytime and night lighting conditions. Accordingly, keys can be produced in accordance with this invention which avoids many of the processing disadvantages encountered with the teachings of the prior art. For example, approaches which utilize various shades of white paint to form a white translucent layer over a transparent substrate, or molding the substrates of backlit components from materials having different light transmission characteristics, are completely unnecessary. The present invention overcomes such drawbacks by enabling the manufacture of backlit components which are suitable for various dissimilar applications, yet can be produced using essentially the same materials in substantially identical molding and finishing operations.

While our invention has been described in terms of a preferred embodiment, it is apparent that other forms could be adopted by one skilled in the art, for example by adopting processing methods other than those suggested here, or by substituting appropriate materials. Accordingly, the scope of our invention is to be limited only by the following claims.

The embodiments of the invention in which an exclusive property or privilege is claimed are defined as follows:

1. A backlit component having a substantially uniform backlighting intensity, the backlit component including a button member comprising an optically clear silicone and at least one phosphor additive dispersed in a portion of the button member, the button member having means for enabling a light source in proximity to the button member to excite the at least one phosphor additive such that the button member will fluoresce when excited by the light source, the at least one phosphor additive generating a substantially uniform backlighting intensity.

2. A backlit component as recited in claim 1 wherein the at least one phosphor additive is dispersed in the optically clear silicone.

3. A backlit component as recited in claim 1 further comprising a coating over the button member.

4. A backlit component as recited in claim 3 further comprising an insignia defined by an opening in the coating, such that a portion of the button member is exposed through the opening.

5. A backlit component as recited in claim 1 further comprising a light source for exciting the at least one phosphor additive.

6. A backlit component as recited in claim 5 wherein the light source is received in the enabling means.

7. A backlit component as recited in claim 5 wherein light emitted by the light source is transmitted by the enabling means to the button member.

8. A backlit component having a substantially uniform backlighting intensity, the backlit component comprising:

a button member formed of at least one phosphor additive dispersed in an optically clear silicone, the at least one phosphor additive being substantially uniformly dispersed in the optically clear silicone such that, upon excitation of the at least one phosphor additive, the button member is characterized by a substantially uniform backlighting intensity;

an insignia defined on a surface of the button member; and a light source in proximity to the button member for exciting the at least one phosphor additive such that the button member will appear to emit light when the at least one phosphor is excited by the light source.

9. A backlit component as recited in claim 8 further comprising a coating over the button member.

10. A backlit component as recited in claim 9 wherein the insignia is defined by an opening in the coating, such that a portion of the button member is exposed through the opening.

11. A backlit component as recited in claim 9 wherein the coating is formed from a material comprising a blend of one or more of the at least one phosphor additive and a carrier.

12. A backlit component as recited in claim 8 wherein the light source is an ultraviolet light source.

13. A backlit component as recited in claim 8 further comprising a recess formed in the button member, the light source being received in the recess.

14. A backlit component as recited in claim 8 further comprising a recess formed in the button member, wherein light emitted by the light source is transmitted by the recess to the button member.

15. A backlit component having a substantially uniform backlighting intensity, the backlit component comprising:

a button member formed of at least one phosphor additive dispersed in an optically clear silicone, the at least one phosphor additive being substantially uniformly dispersed in the optically clear silicone such that, upon excitation of the at least one phosphor additive, the button member is characterized by a substantially uniform backlighting intensity;

a coating disposed on at least a portion of the button member so as to define an insignia with an exposed portion of the button member; and a ultraviolet light source in proximity to the button member to excite the at least one phosphor additive such that the button member will appear to emit light when the at least one phosphor is excited by the light source.

16. A backlit component as recited in claim 15 wherein the coating is formed from a material comprising a blend of one or more of the at least one phosphor additive and a carrier.

17. A backlit component as recited in claim 15 wherein the coating is composed of a plurality of coatings.

18. A backlit component as recited in claim 15 further comprising a recess formed in the button member, the light source being received in the recess.

19. A backlit component as recited in claim 15 further comprising a recess formed in the button member, wherein light emitted by the light source is transmitted by the recess to the button member.

20. A backlit component as recited in claim 15 wherein the at least one phosphor additive comprises a plurality of phosphor additives, and wherein at least one of the plurality of phosphor additives emits a light whose color differs from that of a second phosphor additive of the plurality of phosphor additives.

* * * * *